US005865132A

United States Patent [19]

Papajewski et al.

[11] Patent Number: 5,865,132

[45] Date of Patent: Feb. 2, 1999

[54] LOOPER DRIVE FOR A BUTTONHOLE SEWING MACHINE

[75] Inventors: Rudy Papajewski, deceased, late of Stutensee, Germany, by Edith Papajewski, Legal Representative; Gerd Papajewski, Stutensee, Germany

[73] Assignee: AMF Reece, Inc., Mechanicsville, Va.

[21] Appl. No.: 604,254

[22] Filed: Feb. 21, 1996

[51] Int. Cl.[6] ..... D05B 5/08; D05B 57/32

[52] U.S. Cl. ..... 112/65; 112/199

[58] Field of Search ..... 112/220, 199, 112/200, 66, 65, 74, 159, 166, 157, 73, 76

[56] References Cited

U.S. PATENT DOCUMENTS

| | | | |
|---|---|---|---|
| 749,721 | 1/1904 | Dahl | 112/157 |
| 749,776 | 1/1904 | Dahl | 112/157 |
| 862,238 | 8/1907 | Dahl | 112/157 |
| 911,551 | 2/1909 | Dahl | 112/157 |
| 1,929,323 | 10/1933 | Maier | 112/199 |
| 2,294,134 | 8/1942 | Smith | 112/220 |
| 2,358,878 | 9/1944 | Pikul | 112/298 |
| 2,733,677 | 2/1956 | Sjogren | 112/220 |
| 2,884,883 | 5/1959 | Reimer | 112/166 |
| 3,318,271 | 5/1967 | De Robert's et al. | 112/65 |
| 3,457,888 | 7/1969 | Wider | 112/157 X |
| 3,602,167 | 8/1971 | Papajewski | 112/167 |
| 3,867,891 | 2/1975 | Grabher | 112/199 X |
| 4,013,028 | 3/1977 | Mukarami | 112/220 |
| 4,022,140 | 5/1977 | Leinemann | 112/199 |
| 4,411,210 | 10/1983 | Killinger | 112/199 |
| 4,463,695 | 8/1984 | Killinger | 112/199 |

*Primary Examiner*—Ismael Izaguirre
*Attorney, Agent, or Firm*—James Creighton Wray; Meera P. Narasimhan

[57] ABSTRACT

A looper drive assembly for a buttonhole sewing machine includes a long arm which is driven by a double cam, followers and an oscillating plate at one end and the arm generally reciprocates longitudinally. V-shaped plates are pivoted at a second end of the arm. Ends of the V-shaped plates are connected to rocking links which carry the looper needles. The links are pivoted on shafts and support the V-shaped plates and the second end of the arm. As the arm reciprocates, the V-shaped plates swing, pull and push lower ends of the link and oscillate the links around shafts for alternating engagement of the looping needles with thread carried through a fabric by a main needle.

26 Claims, 3 Drawing Sheets

LOOPER DRIVE FOR A BUTTONHOLE SEWING MACHINE

BACKGROUND OF THE INVENTION

The present invention relates to an improved looping mechanism used to facilitate stitching in buttonhole sewing machines. Specifically, this invention allows the looping needles to engage the thread of the main needle which is passed through a garment in which a buttonhole is to be formed.

Sewing machines repeatedly stitch and shift fabric through an intricate sequence of movements. To make a stitch, the sewing machine moves a main needle up and down through the cloth, carrying thread with it. As the main needle comes up from the bottom of its stroke, a looper needle catches and secures the thread, creating a loop. When the main needle descends again, the main needle enters the thread loop, and the loop starts to slide off the looper needle. As the main needle continues to descend, the thread loop slides off the looper needle and is drawn up on the succeeding stroke. Two looper needles are used so that one can reset while the other is creating a loop in the thread.

Needs exist for a reliable, simplified looper apparatus and methods for promoting long lasting error free sewing machines.

SUMMARY OF THE INVENTION

The single arm design and small motion of the rocker plate allow the system to operate with fewer parts than other looper assemblies and fewer potential sources of failure. The control of both looping needles by a single actuator provides for additional reliability.

The prior art does not demonstrate the simplicity and reliability of the present looper mechanism. While many previous inventions allow for proper looping of the thread about the main needle, the use of a single arm, single actuator and fewer parts allows for greater mechanical stability of the mechanism.

An objective of the present invention is to remedy the disadvantages of the prior art by providing a reliable apparatus that allows users to form buttonholes in garments. The double pivoting coupling assembly allows small movements of the looper to engage the thread introduced by the main sewing machine needle and to loop it efficiently to create uniform stitching. A single reciprocating arm provides the motion to loop the thread with the looper needles. The limited number of parts creates fewer chances and opportunities for wear and failure. Fewer parts need to be replaced in the event of wear of some part of the mechanism.

In a preferred embodiment, once the machine is engaged, a looper cam is driven by a drive shaft, and a cam follower provides motion to one end of an arm. The second end of the arm is supported on rocker plates, links, and shafts for enabling back and forth generally horizontal movement of the arm. The motion of the arm causes the rocker plates to swing back and forth. This motion provides an impetus to the connecting links to move with opposite motions, causing the looping needles to alternately move back and forth. The looping needles engage thread that has been pushed through the cloth by the main needle and cause loops to form in the thread.

A preferred looper drive apparatus for a sewing machine has an arm with an actuator connected to a first end of the arm for driving the arm back and forth. A coupling supports the other end of the arm. The coupling is pivotally coupled to at least one shaft mounted in a shaft block. Looping needles extending from the coupling alternately engage thread presented by a main needle.

Preferably, the coupling is generally V-shaped, and is connected pivotally at its center to the second end of the arm. Distal ends of the coupling are connected pivotally to at least one shaft.

Preferably, the looper coupling has two rocker plates pivoted on the arm and two connecting links positioned between the rocker plates. The upper part of each connecting link pivots on the at least one shaft.

A first roller extends between the central holes in the rocker plates and through a hole in the second end of the arm for rotatably connecting the rocker plates to the arm.

In a preferred embodiment, the at least one shaft is a pair of shafts. Each shaft extends from the block through an upper cavity of each link respectively. The preferred shafts are recessed at ends closest to the block. A collar is positioned around the end of each shaft. In addition, rollers extend between the rocker plates and through the lower cavities of both links.

Needle cages are positioned in the hole in the second end of the arm and in the lower cavities of the first and second links. Each needle cage has an axial aperture that accommodates a roller.

The preferred arm has a tapered middle section extending between the first end and the second end. The ends are thicker than the middle section.

The preferred links are rounded at their lower ends and squared at their upper ends. A hole in the upper end of each link extends down to the upper cavity so that a looper needle can be secured in the hole.

The preferred looper needles extend from the upper parts of the links and swing in arcs to where the main needle extends below the workpiece. The bases of the looper needles have mounts that are fastened in holes in the uppers parts of the links. The tops of the looper needles are hooked to enable them to catch the thread as it is introduced by the main needle.

The preferred shaft block has a pair of holes for set screws that keep the shafts secured in the block. It also has a pair of holes for mounting the block to a frame and a bottom with a recessed notch to keep the block secured. Ends of a pair of holes which pass through the body of the shaft block have bushings to aid in supporting the shafts.

In a preferred embodiment, the actuator is formed with a looper cam follower plate. A cam is positioned in operational with the cam follower rollers on the follower plate for driving the plate. The plate has an extension connected to the first end of the arm and provides motion to the arm's first end.

The looper cam is a double cam with cams extending from the middle and one of the ends. The follower plate has cam follower rollers mounted in two holes on the follower plate, one on each side of the follower plate. Each cam makes contact with only one follower roller, and the follower plate is positioned between the two cams of the looper cam.

These and further and other objects and features of the invention are apparent in the disclosure, which includes the above and ongoing written specification, with the claims and drawings.

DETAILED DESCRIPTION OF THE DRAWINGS

Figures 1, 2:
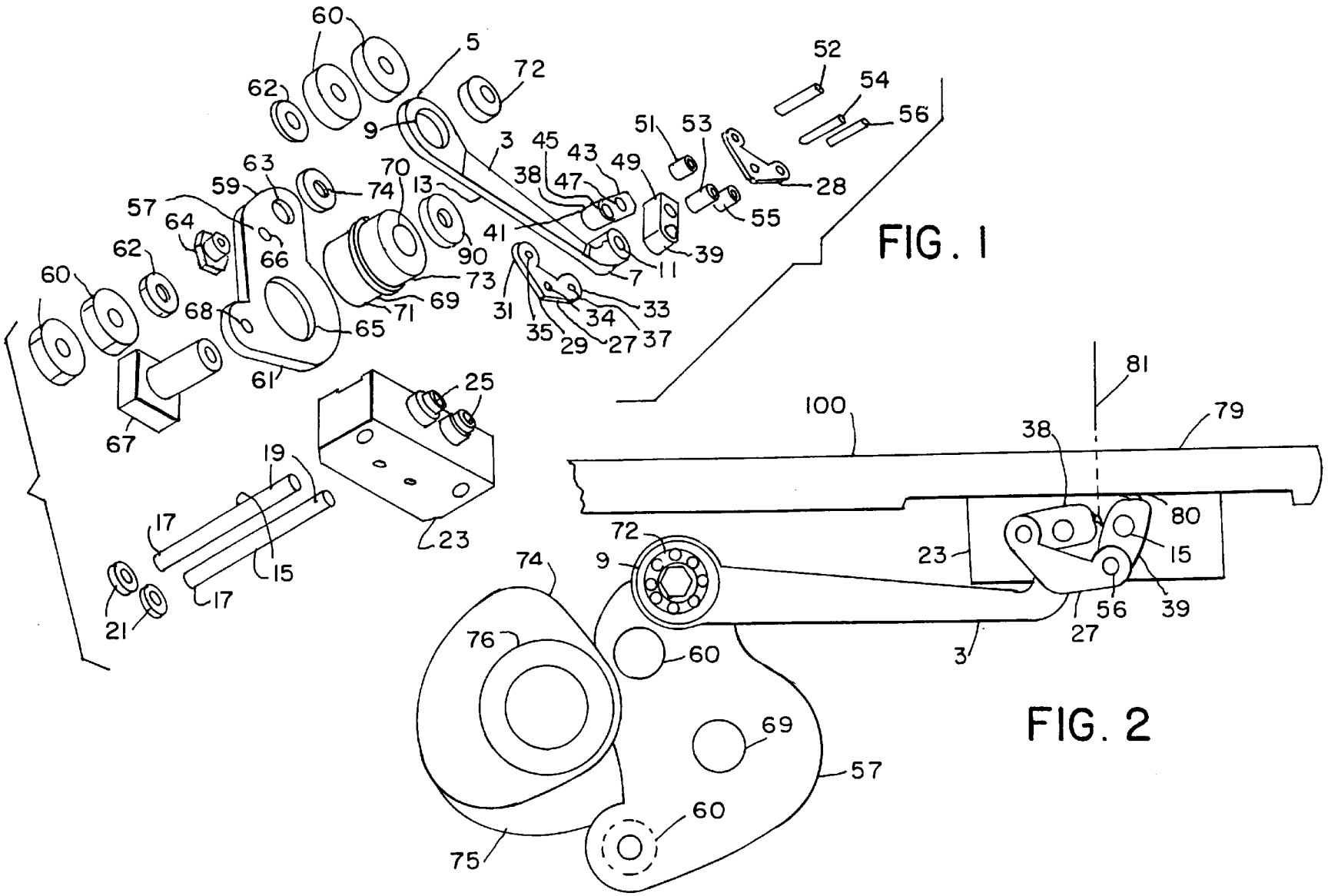
FIG. 1 is an exploded perspective view of a looper mechanism.
FIG. 2 is a schematic elevation of the looper of FIG. 1 in a buttonhole sewing machine.
Figure 3:
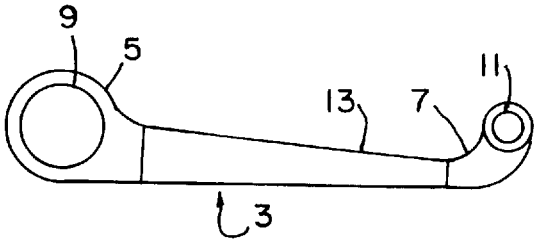
FIG. 3 is an elevation of an arm showing a tapered middle section and thicker first and second ends.

Referring to FIG. 1, a looper mechanism 1 for a buttonhole sewing machine is shown in an exploded view. An arm 3 has a first end 5 and a second end 7. A first opening 9 passes through the first end 5, and a second opening 11 passes through the second end 7. The arm has a middle section 13 that is narrower that either of the ends. The areas around the ends are thicker to provide added support for first and second openings 9, 11.

Figure 7:
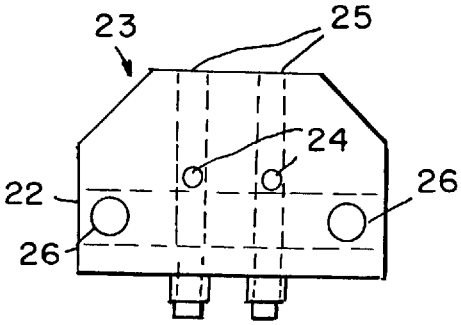
FIG. 7 is a plan view a shaft block.
Figure 8:
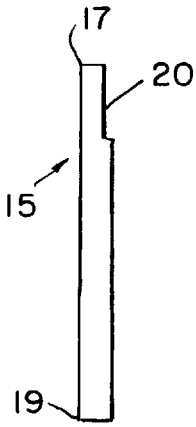
FIG. 8 is an elevation of one shaft
Figure 9:
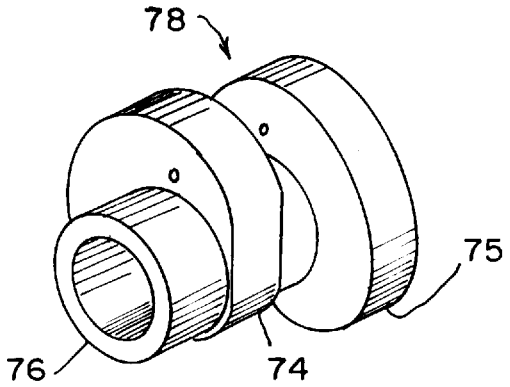
FIG. 9 is a perspective view of a looper cam with double cams.
Figure 10:
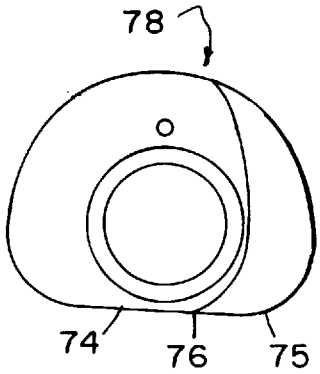
FIG. 10 and 11 are end and cross sectional views respectively of a looper cam with double cams shown in FIG. 9.
Figure 11:
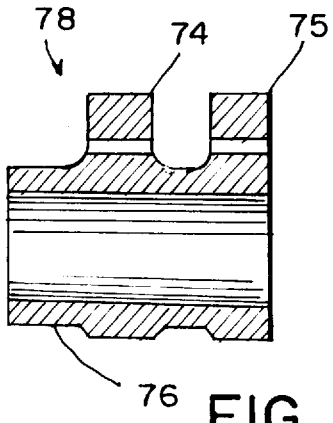

Two shafts 15 as shown in FIGS. 1 and 8, each have block ends 17 and link ends 19. Collars 21 are attached to the shafts 15 at the block ends 17. The block ends 17 have recessed portions 20. The shafts 15 pass through holes 25 in the shaft block 23 which is shown in FIGS. 1 and 7. A first pair of holes 26, passing through the thickness of the shaft block 23 and set apart from each other, are used to secure the shaft block to a base. Each of the holes of the second pair of holes 25 has a bushing to aid in the supporting of the shafts 15. A third pair of holes 24 is situated perpendicular to the shaft holes and intersects them such that the position of the shafts can be fixed within the shaft holes. An indentation in the shaft block 22 is used to help position secure the shaft block.

Figure 4:
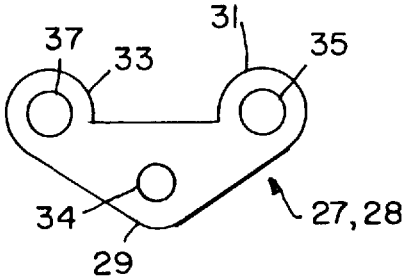
FIG. 4 is an elevation of a rocker plate, showing the V-shaped form of the plate and detailing the holes in a middle portion and in outer ends.
Figure 6:
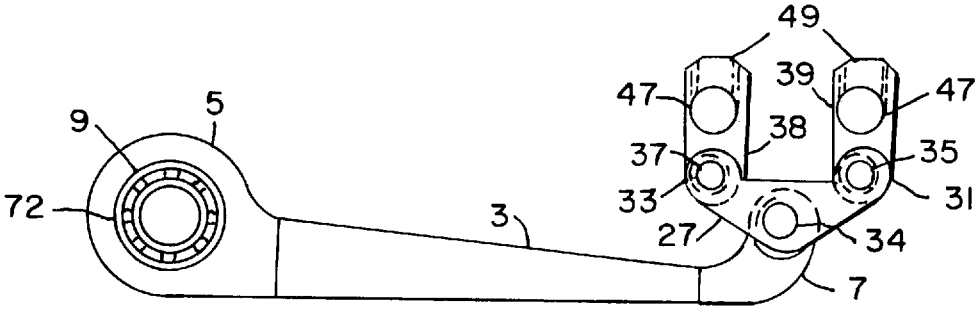
FIG. 6 is an assembly elevation of the arm and a coupling mechanism, which includes rocker plates and links.

Rocker plates 27, 28 shown in FIGS. 1, 4 and 6 have middle portions 29 and first and second outer ends 31, 33. Each plate has a first hole 34 in the middle 29, a second hole 35 in first outer end 31 and a third hole 37 in the second outer end 33. The second and third holes 35, 37 are equidistant from the first hole 34, so that the rocker plate can be balanced about the first hole 34.

Figure 5:
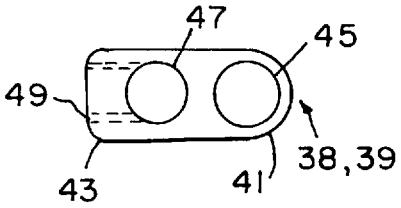
FIG. 5 is an elevation of a connecting link showing cavities in upper and lower parts of the link.

Two connecting links 38, 39 shown in FIGS. 1, 5, and 6 have lower parts 41 and upper parts 43 respectively. A lower cavity 45 passes through the lower part 41 and an upper cavity 47 passes through the upper part 43. The connecting links 39 also have holes 49 in upper ends of the links. The upper cavities are supported by the shafts 15 which extend from the fixed shaft block 23.

First, second, and third needle cages 51, 53, 55 with axial apertures of size for accepting the first, second, and third needle rollers 52, 54, 56 are used to make the connections between the parts. The first needle cage 51 is mounted in hole 11 of the arm 3. The first needle roller 52, inside of the first needle cage 51, connects the first rocker plate 27, through the first hole 34, through the second opening 11 of the arm 3 to the first hole 34 of the second rocker plate 28. The connection allows the rocker plates 27, 28 to pivot the roller 11 in the arm 3. The second and third needle cages 53, 55 are pressed into lower cavities in the links. The second needle bearing 52, inside of a needle cage 53, connects the rocker plates 27, 28 through the second holes 35, and through the first cavity 45 of the first connecting link 38. The third needle roller 56, inside of a needle cage 55, connects the rocker plates 27, 28 through the third holes 37, and through the lower cavity 45 of the second connecting link 39. Those connections allow the connecting links 38, 39 to pivot about their lower cavities 45 with respect to the rocker plates 27, 28.

Figure 12:
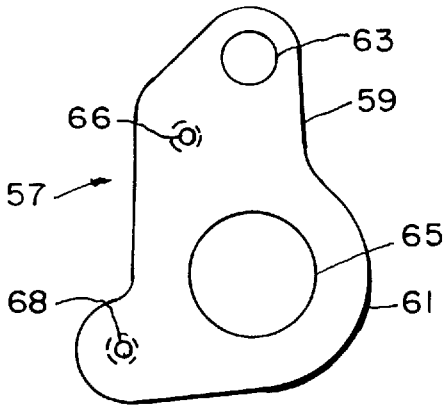
FIG. 12 is an elevation of a looper cam follower plate showing the large hole for the bearing and fixed pivot, the small holes for mounting cam follower rollers and the off-axial hole that is connected to the first end of the arm.

The assembly is activated by an actuator, which includes of the cam follower plate 57, shown in FIGS. 1, 2, 12. The plate has a larger, lower section 61 and a smaller, upper section 59. Small apertures 66, 68 mount cam follower rollers 60 and follower roller washers 62 at spaced locations. An arm aperture 63, close to the top end, mounts a guide 64 for connecting to a standoff washer 74 and a bearing 72 in the opening in the first end of the arm 3. In the center, a large aperture 65 receives a bearing 69 for mounting on a fixed pivot 67 around which the follower plate oscillates.

Bearing 69, which has a first end 71, a second end 73 and an axial center opening 70, fits in the large aperture 65 of the cam follower plate 57. A fixed pivot 67, passes through the axial center opening 70, and allows the cam follower plate 57 to oscillate about the fixed pivot 67.

In operation, the cam follower plate 57 is pivoted about the fixed pivot 67. The plate 57 moves the arm 3 back and forth in a reciprocating motion. The motion of the arm 3 causes the rocker plates 27, 28 to rock, pivoting about their centers. The motion of the rocker plates 27, 28 causes the connecting links 38, 39 to pivot about the cavities in their upper parts 43 around shafts 15, which are held in place by the shaft block 23. The motion of the connecting links 38, 39 causes an opposite swinging of the links, which moves looper needles in the desired motion.

Referring to FIG. 2, a looper mechanism is mounted in a button hole sewing machine 100. An arm 3 is attached to a rocker plate 27 which is connected to connecting links 38, 39. The connecting links 38, 39 pivot on shafts 15. Looper needles 80 are connected to the connecting links at upper parts, which are closest to a base 79 of the sewing machine.

The arm 3 is connected to a cam follower plate 59 at an arm aperture 63. Two small apertures 66, 68 mount follower roller washers 62 and cam follower rollers 60 that make operational contact with double cams 74, 75. The cam follower plate 57 pivots about a fixed shaft 67 on a bearing 69 through a large aperture 65 of the cam follower shaft.

In FIGS. 2, 9, 10, and 11, a looper cam 78 has a cylindrical body 76 with first and second ends. A first cam 74 extends around a middle portion of the cylindrical body and a second cam 75 extends around the cylindrical body near the second end of the trunk.

In operation, the main needle 81 introduces thread through a workpiece, which is clamped to the base 79. An opening in the base 79 allows the needle to pass below the plane of the base to where the looping needles 80 are. The looping needles, swinging oppositely back and forth, catch the thread and hold the thread temporarily until the next cycle of the needle.

The motion of the looping needles is produced by the oscillating of the connecting links 38, 39 on the shafts 15.

The motion of the connecting links 38, 39 is transferred from the rocker plates 27, 28, which rock back and forth about a pivotal connection to the arm 3.

The rocking of the rocker plates 27, 28 is caused by the reciprocating motion of the arm 3 which receives the motion from the cam follower plate 57 pivotally connected to the arm 3. In turn, the cam follower plate 57 derives its motion from the looper cam 78.

While the invention has been described with reference to specific embodiments, modifications and variations of the invention may be construed without departing from the scope of the invention, which is defined in the following claims.

It is claimed:

1. A looper drive apparatus for a sewing machine comprising an arm having a first end and a second end, an actuator connected to the first end of the arm for driving the arm back and forth, a coupling pivotally connected to the second end of the arm, at least one looser needle-carrying link pivotally connected to the coupling, a shaft block, at least one shaft extending from the block and pivotally connected to the link, and a looping needle extending from the at least one link for engaging thread presented by the main needle, wherein the at least one looper needle-carrying link is a pair of looper needle-carrying links for alternately engaging thread presented by the main needle.

2. A looper drive apparatus for a sewing machine comprising an arm having a first end and a second end, an actuator connected to the first end of the arm for driving the arm back and forth, a coupling pivotally connected to the second end of the arm, at least one looper needle-carrying link pivotally connected to the coupling, a shaft block, at least one shaft extending from the block and pivotally connected to the link, and a looping needle extending from the at least one link for engaging thread presented by the main needle, wherein the coupling is generally V-shaped with a center and two distal ends, with the center of the coupling pivotally connected to the second end of the arm and a first and a second looper needle-carrying link pivotally connected to each distal end and are pivotally supported by the at least one shaft.

3. A looser drive apparatus for a sewing machine comprising an arm having a first end and a second end, an actuator connected to the first end of the arm for driving the arm back and forth, a looper needle-carrying coupling pivotally connected to the second end of the arm, a shaft block, at least one shaft extending from the block and pivotally connected to the coupling and at least one looping needle extending from the coupling for engaging thread presented by a main needle, wherein the coupling further comprises first and second rocker plates connected to the second end of the arm and first and second connecting links positioned between the first and second rocker plates, wherein each connecting link has a lower part and an upper part, and wherein the lower part of each connecting link is pivotally connected to the rocker plates and the upper part of each connecting link is connected to at least one shaft.

4. The apparatus of claim 3, wherein each connecting link has a hole in the upper part that extends inward from an upper end of the link, and where one of the pair of looping needles is secured in each of the holes in the upper parts.

5. The apparatus of claim 3, further comprising an opening extending through the second end of the arm, wherein the first and second rocker plates are positioned on opposite sides of the second end of the arm, wherein each rocker plate further comprises first and second outer ends and a middle portion, a first hole at the middle portion, a second hole at the first outer end and a third hole at the second outer end, and further comprising a first bearing extending between the first holes of the first and second rocker plates and through the opening in the second end of the arm for rotatably connecting the rocker plates to the arm.

6. The apparatus of claim 5, wherein the links are positioned between the outer ends of the rocker plates, wherein each link further comprises an upper cavity extending through the upper part and a lower cavity extending through the lower part, wherein the at least one shaft is a pair of shafts, each shaft having a block end extending through the block and a link end extending into the upper cavity of the first or second link, and further comprising a second bearing extending between the second holes of the rocker plates and through the lower cavity of the first link and a third bearing extending between the third holes of the rocker plates and through the lower cavity of the second link.

7. The apparatus of claim 6, further comprising a first needle cage positioned in the opening of the second end of the arm, a second needle cage positioned in the lower cavity of the first link and a third needle cage positioned in the lower cavity of the second link, and wherein each needle cage has a cylindrical shape and has an axial aperture with a size for accepting the bearings.

8. The apparatus of claim 6, wherein the block end of each shaft is recessed, and further comprising a collar positioned around the block end of each shaft.

9. A looper drive apparatus for a sewing machine comprising an arm having a first end and a second end, an actuator connected to the first end of the arm for driving the arm back and forth, a coupling pivotally connected to the second end of the arm, at least one looper needle-carrying link pivotally connected to the coupling, a shaft block, at least one shaft extending from the block and pivotally connected to the link, and a looping needle extending from the at least one link for engaging thread presented by the main needle, further comprising a first opening extending through the first end of the arm and a second opening extending through the second end of the arm, wherein the arm has a tapered middle section extending between the first end and the second end, wherein the middle section decreases in width from the first end to the second end, and wherein the first and second ends are thicker than the middle section.

10. A looper drive apparatus for a sewing machine comprising an arm having a first end and a second end, an actuator connected to the first end of the arm for driving the arm back and forth, a looper needle-carrying coupling pivotally connected to the second end of the arm, a shaft block, at least one shaft extending from the block and pivotally connected to the coupling and at least one looping needle extending from the coupling for engaging thread presented by a main needle, wherein the actuator further comprises a looper cam follower plate connected to the first end of the arm for providing motion to the arm and a cam positioned in operational contact with the follower plate for driving the plate, and hence the arm.

11. The apparatus of claim 10, wherein the follower plate further comprises a fixed pivot and first and second spaced follower rollers oppositely extending from the plate for contacting the cam and wherein the cam has double lobes for contacting the rollers.

12. A method of looping thread in a buttonhole sewing machine comprising the steps of driving a first end of an arm back and forth with an actuator, swinging a second end of the arm pivotally connected to a looper needle-carrying coupling, rocking the looper needle-carrying coupling about at least one shaft, extending the at least one shaft from a shaft block, supporting and moving the coupling through a pivotal connection between the at least one shaft and the coupling and causing a pair of looping needles, disposed in needle carrying links extending from the pivotal connection, to alternately engage thread presented by a main needle.

13. The method of claim 12, wherein the supporting and moving comprise pivotally connecting a center of a V-shaped coupling to the second end of the arm and pivotally connecting the coupling to the at least one shaft through outer ends of the coupling.

14. A method of looping thread in a buttonhole sewing machine comprising the steps of driving a first end of an arm back and forth with an actuator, swinging a second end of the arm on a looser needle-carrying coupling, rocking the looper needle-carrying coupling about at least one shaft, extending the at least one shaft from a shaft block, supporting and moving the coupling through a pivotal connection between the at least one shaft and the coupling, and causing a pair of looping needles extending from the coupling to alternately engage thread presented by a main needle, wherein the supporting and moving further comprise rocking first and second rocker plates by central pivotal connections to the second end of the arm and swinging first and second connecting links with upper parts and lower parts positioned between outer ends of the first and second rocker plates, and further comprising swinging the links back and forth by the rocker plates through pivotal connections between the lower parts of the connecting links and the rocker plates and supporting the links with pivotal connections between the upper parts of the connecting links and at the least one shaft.

15. The method of claim 14, wherein the motion of the arm is translated to the first and second rocker plates positioned on opposite sides of the second end of the arm and wherein each rocking plate further comprises first and second outer ends, distal ends and a middle portion, a first hole at the middle portion, second and third holes respectively at the outer ends and wherein motion from the arm to the rocker plates is transferred through a first roller extending between the first holes of the first and second rocker plates and through the opening in the second end of the arm for rotatably connecting the rocker plates to the arm.

16. The method of claim 15, wherein the rocker plates rock the links which are positioned between outer ends of the rocker plates, wherein each link further comprises a lower cavity extending through an entire thickness of the lower part and an upper cavity extending through the entire width of the upper part, wherein the at least one shaft is a pair of shafts, each shaft having a block end extending through the block and a link end extending into the upper cavity of the first or second link, constraining the rocking of the links, and wherein the rocking of first link by the rocker plate is transferred by a second roller extending between the second holes of the rocker plate and through the lower cavity of the first link, and the rocking of second link by the rocker plate is transferred by a third roller extending between the third holes of the rocker plates and through the lower cavity of the second link.

17. The method of claim 15, wherein the motion of the arm is transferred to the rocker plate through a first needle cage positioned in the opening of the second end of the arm, the motion of the rocker plate is transferred to the first link through a second needle cage positioned in the lower cavity of the first link and the notion of the rocker plate is transferred to the second link through a third needle cage positioned in the lower cavity of the second link, and wherein each needle cage has a cylindrical shape and has an axial aperture with a size for accepting one of the rollers.

18. A method of looping thread in a buttonhole sewing machine comprising the steps of driving a first end of an arm back and forth with an actuator, swinging a second end of the arm on a looser needle-carrying coupling, rocking the looser needle-carrying coupling about at least one shaft, extending the at least one shaft from a shaft block, supporting and moving the coupling through a pivotal connection between the at least one shaft and the coupling, and causing a pair of looping needles extending from the coupling to alternately engage thread presented by a main needle, wherein the actuator further comprises a looper cam follower plate connected to the first end of the arm which moves the first end of the arm in a reciprocating motion and a cam in operational contact with the follower plate which drives the motion of the plate, and hence the motion of the arm.

19. The apparatus of claim 18, wherein the V-shaped rocker plates are centrally pivotally connected to the second end of the arm, the first V-shaped rocker plate positioned on one side of the second end of the arm, the second V-shaped rocker plate positioned on an opposite side of the second end of the arm, the first and second rocker plates each having a first central opening positioned at a middle portion of the rocker plate and second and third openings positioned at outer ends of the rocker plates, a first needle roller extending through the first opening in the first rocker plate, extending through an opening in the second end of the arm and through the first opening in the second rocker plate for connecting the rocker plates to the arm, the first connecting link positioned between the second openings of the rocker plates and having an upper cavity and a lower cavity, a second needle roller extending through the second opening in the first rocker plate, the lower cavity in the first connecting link and the second opening in the second rocker plate for connecting the first connecting link to the rocker plates, the second connecting link positioned between the third openings of the rocker plates and having an upper cavity and a lower cavity, and a third needle roller extending through the third opening in the first rocker plate, the lower cavity in the second connecting link, and the third opening in the second rocker plate for connecting the second connecting link to the rocker plate.

20. The apparatus of claim 19, further comprising a collar positioned around a block end of each shaft.

21. The apparatus of claim 19, wherein each connecting link has an opening in an upper end that extends outward from the upper cavity, and further comprising a looping needle positioned in the opening for engaging and holding a thread.

22. The apparatus of claim 18, further comprising a first needle cage positioned in the opening of the second end of the arm for receiving the first needle bearing, a second needle cage positioned in the lower cavity of the first connecting link for receiving the second needle bearing, and a third needle cage positioned in the lower cavity of the second connecting link for receiving the third needle bearing.

23. The apparatus of claim 18, wherein the arm has a thin, long body portion connecting the first end and the second end, the ends being shorter and wider than the body portion, and wherein the first end has a large opening extending through the first end for receiving the reciprocating means and the second end has an opening for receiving a connector for pivotally connecting the rocker plates and connecting links to the arm.

24. The apparatus of claim 18, wherein the driver further comprises a drive shaft for providing rotary motion, a follower plate having a fixed pivot and first and second spaced cam follower rollers oppositely extending from the plate, and a looper cam having a cylindrical body with a first end, a second end, a first cam extending around the cylindrical body near the second end and a second cam extending around the cylindrical body near a middle portion, wherein the follower plate is positioned between the first and second cams of the looper cam, where each cam follower roller makes contact with one of the cams, such that as the looper cam rotates, the follower plate makes a reciprocating motion.

25. A looper mechanism apparatus for a buttonhole sewing machine comprising an arm having a first end and a second end, a driver connected to the first end of the arm for driving the arm and for reciprocating the arm longitudinally, first and second V-shaped rocker plates pivotally connected to the second end of the arm, first and second connecting links pivotally connected to the rocker plates, shafts connected to the first and second connecting links and looping needles extending from the connecting links for looping and holding thread carried by a main needle.

26. The apparatus of claim 25, wherein the shafts comprise a pair of shafts mounted in a shaft block and connected to the connecting links, a first shaft of the pair extending from the block through the upper cavity of the first connecting link, and a second shaft of the pair extending from the block and through the upper cavity of the second connecting link.

* * * * *